US005251361A

United States Patent [19]

Owens et al.

[11] Patent Number: 5,251,361

[45] Date of Patent: Oct. 12, 1993

[54] LADIES BELT CLIP

[76] Inventors: Leanne M. Owens; Robert J. Owens, both of 2859 Via Cordoba Ct., San Ramon, Calif. 94583

[21] Appl. No.: 688,161

[22] Filed: Apr. 19, 1991

Related U.S. Application Data

[63] Continuation of Ser. No. 543,657, Jun. 26, 1990, Pat. No. 5,044,049.

[51] Int. Cl.[5] ..... A44B 11/00

[52] U.S. Cl. ..... 24/182; 24/3 J; 24/169; 24/543

[58] Field of Search ..... 24/182, 169, 163 K, 24/170, 176, 543, 546, 301, 116 A, 590, 596, 3 L, 3 R, 3 M, 3 J, 3 K, 30.5 R, 67.9, 522

[56] References Cited

U.S. PATENT DOCUMENTS

| | | | |
|---|---|---|---|
| D. 112,997 | 1/1939 | Howard . | |
| D. 141,949 | 8/1945 | Pivcevich . | |
| D. 239,147 | 3/1976 | Karlsen . | |
| D. 295,501 | 5/1988 | Brayford . | |
| 1,414,048 | 4/1922 | Schlutz . | |
| 1,477,680 | 12/1923 | Betlin | 24/3 M |
| 1,495,925 | 5/1924 | Quertermous | 24/182 |
| 1,552,156 | 9/1925 | Heller | 24/3 K |
| 1,618,573 | 2/1927 | Cole | 24/3 J |
| 1,682,536 | 8/1928 | Otten | 24/543 |
| 2,084,503 | 6/1937 | Rogers | 24/299 |
| 2,644,994 | 7/1953 | Smith | 24/182 |
| 3,458,110 | 7/1969 | Goldman | 24/30.5 R |
| 3,561,066 | 2/1971 | Osteen | 24/3 L |
| 3,866,276 | 2/1975 | Perkins | 24/543 |
| 4,060,876 | 12/1977 | DeSoto | 24/3 J |
| 4,280,254 | 7/1981 | Racke | 24/163 K |
| 4,587,818 | 5/1986 | Griffin | 24/3 R |
| 4,619,020 | 10/1986 | Lecher, Sr. | 24/3 J |
| 4,627,132 | 12/1986 | Markham | 24/169 |
| 4,814,303 | 4/1989 | Udelhofen | 24/182 |

FOREIGN PATENT DOCUMENTS

| | | | |
|---|---|---|---|
| 0315982 | 7/1929 | United Kingdom | 24/3 R |

*Primary Examiner*—Victor N. Sakran

[57] ABSTRACT

A device for releasably securing the free end of a belt to the body of the belt in the form of a unitary resilient spring clip adapted for fitting over the free end portion of the belt and a desired adjacent portion of the body of the belt and forcing such portions tightly together for releasably holding the free end portion of the belt from dangling, a flexible chain being secured at one end to the clip and having a second end engageable through a hole in the body of the belt for preventing loss of the clip if it falls off the belt, the chain having a small bar on its free end insertable endwise through the hole in the belt.

2 Claims, 1 Drawing Sheet

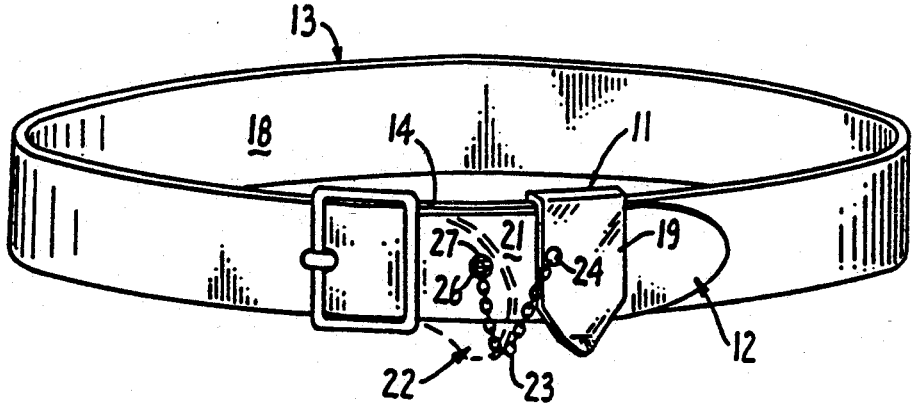
FIG. 1.
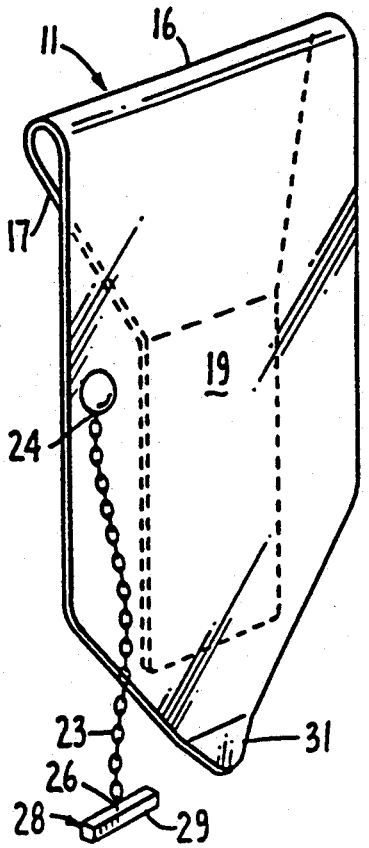
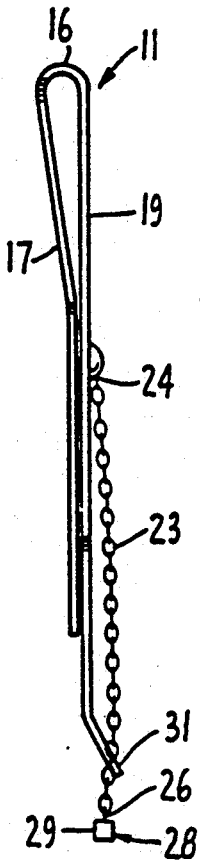
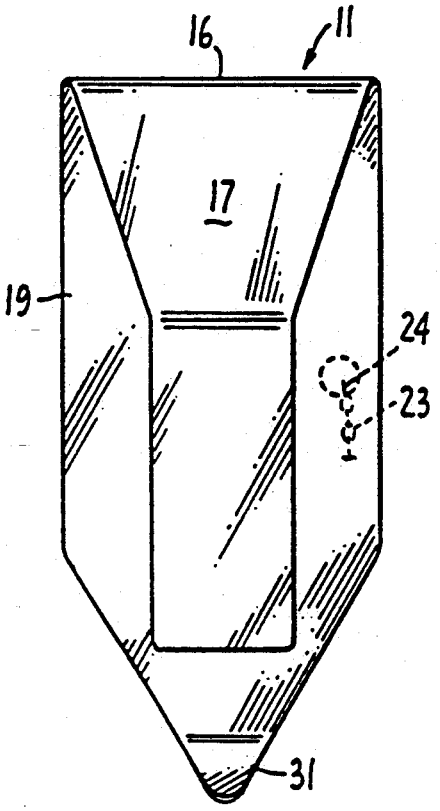
FIG. 2. FIG. 3 FIG. 4.

LADIES BELT CLIP

This is a continuation of co-pending application Ser. No. 07/543,657 filed on Jun. 26, 1990 now U.S. Pat. No. 5,044,049.

BACKGROUND OF THE INVENTION

1. Field of the Invention

This invention relates to ladies belt accessories, and more particularly to devices for supporting the dangling free end of the belt in alignment with the body of the belt.

2. Description of the Prior Art

Ladies belts come in a variety of lengths and are made of a wide variety of materials ranging from thin, supple material such as cloth or glove leather to relatively thick and stiff leather or braided or woven belts of materials such as cotton. When buckled, the free end of the belt hangs down in an unslightly manner unless it is somehow supported next to and in alignment with the main portion of the belt encircling the waist of the user.

Various devices have been proposed for supporting the loose belt end in devices having a closed loop portion threaded onto the belt and another portion which can be clamped onto the loose belt end. Typical of these devices are those shown and described in U.S. Pat. No. 1,414,048 issued Apr. 25, 1922 to Henry Schlutz, and U.S. Pat. No. 4,627,132 issued Dec. 9, 1986 to Vivian C. Markham.

A belt loop stay consisting of a single loop which is threaded on the belt and through which the free end of the belt is threaded is shown and described in U.S. Pat. No. 4,819,303 issued Apr. 11, 1989 to Mark J. Udelhofen.

A belt clasp is shown in U.S. Pat. No. Des. 112,997. The patent contains no information at all as to how or where the belt clasp is used, nor whether it has anything to do with supporting the free end of the belt.

Clip devices for uses other than in connection with belts are shown in U.S. Pat. No. Des. 141,949 issued Aug. 7, 1945 to John F. Pivcevich; U.S. Pat. No. Des. 239,147 issued Mar. 16, 1976 to Ralph M. Karlsen; and U.S. Pat. No. Des. 295,501 issued May 3, 1988 to Ernest E. Brayford.

The above-listed patents are believed to be relevant to the present invention because they were adduced by a prior art search made by an independent searcher, and a copy of each of the above-listed patents is supplied to the Patent and Trademark Office herewith.

SUMMARY OF THE INVENTION

The ladies belt clip of the present invention does not provide a loop slidable on the body of the belt, but rather clips onto and grasps both the body of the belt and the free end of the belt so as to hold the free end in alignment with the body of the belt. The device for releasably securing the free end of the belt to the body of the belt in desired position is in the form of a unitary resilient spring clip adapted for fitting over the free end portion of the belt and a desired portion of the body of the belt and forcing such portions tightly together for releasably holding the free end portion of the belt from dangling.

Because the ladies belt clip of the present invention is held in place on the belt solely by friction engendered by the clamping action of the clip, it is possible for the clip to work loose and, not being threaded on the body of the belt, it is possible for the clip to be lost.

In accordance with the present invention, means is provided for releasably securing the unitary spring clip to the body of the belt without having any portion encircling the belt. This means provides a flexible ornamental chain having a first end secured to the clip and a second end adapted to pass through a hole in the body of the belt. Retaining means is carried on the second end of the chain and is formed for selectively preventing withdrawal of the second end of the chain from the hole in the body of the belt.

The retaining means is here in the form of a bar mounted on the second end of the chain for movement between a first position closely parallel to the chain for insertion of the bar and the end of the chain through the hole in the body of the belt, the bar being movable to a second position perpendicular to the chain for retaining the second end of the chain from being withdrawn from the hole until the bar is turned endwise to the hole.

Preferably, the unitary spring clip is formed from a flat sheet of spring metal bent back on itself to provide a rear portion slidably engageable downwardly over the inner face of the body of the belt and a front portion slidably engageable downwardly over the outer face of the free end of the belt so as to clamp the body of the belt and the free end of the belt firmly together.

The ladies belt clip of the present invention is well adapted for being made in various ornamental configurations and for carrying ornamentation on the outer face of the clip. Such ornamentation cooperates with ornamental appearance of the chain for releasably securing the clip to the body of the belt to provide an attractive as well as useful device.

It is therefore a principal object of the present invention to provide a ladies belt clip device capable of releasably securing the free end of a belt to the body of the belt by clipping over the free end portion of the belt and a desired portion of the body of the belt and forcing such portions tightly together.

Another object of the present invention is to provide a ladies belt chip device for releasably securing the free end of a belt to the body of the belt, of the character described, which releasably secures the unitary spring clip to the body of the belt without encircling the belt.

A further object of the present invention is to provide a ladies belt clip device of the character described in which a flexible ornamental chain is provided for securing the spring clip to the body of the belt, with the chain being releasably secured to the body of the belt through a hole formed therethrough.

Other objects and features of advantage will become apparent as the specification progresses, and from the claims.

BRIEF DESCRIPTION OF THE DRAWINGS

FIG. 1 is a perspective view of a ladies belt clip constructed in accordance with the present invention and shown in installed position on a ladies belt.

FIG. 2 is an enlarged perspective view of the ladies belt clip of FIG. 1.

FIG. 3 is a side elevational view of the ladies belt clip of FIG. 2.

FIG. 4 is a rear elevational view of the ladies belt clip of FIG. 2.

While only the preferred form of the invention is illustrated in the drawings, it will be apparent that various modifications could be made without departing from the ambit of the claims.

DESCRIPTION OF THE PREFERRED EMBODIMENT

The device of the present invention is in the form of a unitary clip 11 of resilient spring material adapted for fitting over the free end portion 12 of a belt 13 and a desired portion of the body 14 of the belt 13, said clip 11 being formed for forcing the described portions of the free end 12 and body 14 of the belt 13 tightly together for releasably holding the free end portion 12 from dangling in the manner illustrated in phantom lines in FIG. 1 of the drawings.

The clip 11 is preferably formed of thin spring steel bent back on itself at the top 16 of the clip in the manner illustrated in the drawings to provide a rear portion 17 slidably engageable downwardly over the inner face 18 of the belt 13 and a front portion 19 slidably engageable downwardly over the outer face 21 of the free end 12 of the belt so as to clamp the body 14 and free end 12 firmly together.

As a feature of the present invention, means 22 is provided for releasably securing the unitary spring clip 11 to the body 14 of the belt 13 without encircling the belt. As here shown, means 22 is in the form of a flexible ornamental chain 23 having a first end 24 secured to the clip 11 and a second end 26 adapted to pass through a hole 27 in the body 14 of the belt 13.

Retaining means 28 on the end 26 of chain 23 is formed for selectively preventing withdrawal of the second end 26 from the hole 27.

Preferably, and as here shown, the retaining means 28 provides a bar 29 mounted on chain end 26 for movement between a first position closely parallel to the chain 23 for endwise insertion through the hole 27, the bar 29 being movable to a second position perpendicular to the chain 23 for retaining the chain end 26 from being withdrawn from the hole 27 until the bar 29 is turned endwise to the hole 27.

It may be seen from FIG. 3 of the drawings that the rear portion 17 and front portion 19 of the clip 11 are close together so that, when the body 14 of the belt and the free end 12 of the belt are forced therebetween, the body and free end will be clamped tightly against each other. Preferably, the bottom end 31 of the front clip portion 19 is bent to incline forwardly at a slight angle, as illustrated in the drawings. The clip 11 may be plated with gold or other metals, or it may be covered with enamel or the like, and embossed ornamentation may be mounted on the outer face 19 of the clip 11, as desired.

From the foregoing, it will be apparent that the ladies belt clip of the present invention provides a novel, handy and useful device for securing the dangling free end of a ladies belt in aligned relation to the rest of the belt, the clip being held in place solely by clamping action and friction, and the clip being restrained against loss by a chain selectively engageable with the belt.

What is claimed is:

1. A device for releasably securing the free end of the belt to the body of the belt, comprising a unitary spring clip adapted for fitting over the free end portion of a belt and desired portion of the body of the same belt and resiliently forcing said belt portions tightly together for preventing said free end portion from dangling, said unitary spring having generally parallel front and rear leaves joined at one end of such leaves by a joining portion with said leaves in closely-spaced relation to each other, the distal ends of said leaves being forced apart when said spring clip is fitted over said free end portion and said body portion of said belt so as to resiliently force said belt portions tightly together; and wherein, means is provided for releasably securing said unitary spring clip to said body of said belt comprising a flexible elongated member having a first end secured to said clip and a second end adapted for releasably securing said member to said body of said belt without encircling said belt.

2. A device as described in claim 1, and wherein said unitary spring clip is formed from a flat sheet of spring metal bent back on itself to provide a rear portion slidably engagable downwardly over the inner face of the body of said belt and a front portion slidably engagable downwardly over the outer face of the free end of said belt so as to clamp said body and said free end of said belt firmly together.

* * * * *